United States Patent [19]

King

[11] 4,282,612

[45] Aug. 11, 1981

[54] ADJUSTABLE SHOWER AND MASSAGE APPARATUS

[76] Inventor: Joseph L. King, 452 Bay Wood Dr., Newport Beach, Calif. 92660

[21] Appl. No.: 144,774

[22] Filed: Apr. 28, 1980

[51] Int. Cl.[3] ..... A47K 3/22

[52] U.S. Cl. ..... 4/601; 4/615; 4/596; 4/605

[58] Field of Search ..... 4/596, 597, 601, 605, 4/612, 615, 616, 619, 598; 239/587

[56] References Cited

U.S. PATENT DOCUMENTS

| | | | |
|---|---|---|---|
| 1,923,425 | 8/1933 | Diedarich | 239/587 |
| 2,759,765 | 8/1956 | Pawley | 4/596 X |
| 2,776,168 | 1/1957 | Schweda | 4/596 X |
| 3,724,760 | 4/1973 | Smith | 4/596 X |
| 3,822,826 | 7/1974 | Wilson | 4/601 X |
| 3,913,839 | 10/1975 | Wilson | 4/601 X |
| 3,971,074 | 7/1976 | Yxfaldt | 4/601 X |
| 3,982,285 | 9/1976 | Robert, Jr. | 4/605 |

*Primary Examiner*—Henry K. Artis

*Attorney, Agent, or Firm*—Francis X. LoJacono

[57] ABSTRACT

An adjustable shower and massage apparatus adapted to be connected to water systems generally associated with bathtubs and stall showers. The apparatus is formed with a plurality of interconnected pipe members, the leading pipe member being attached to the water system and the trailing or end pipe being affixed to a stationary member such as a wall. The pipe members are interconnected by a plurality of universal joints which allow the contiguous pipe members and a connected shower-spray head to be positioned at any selected angular position, whereby water can be directed to any part of an individual's body, the apparatus including a handle for positioning the pipe members.

6 Claims, 5 Drawing Figures

ADJUSTABLE SHOWER AND MASSAGE APPARATUS

BACKGROUND OF THE INVENTION

1. Field of the Invention

This invention relates generally to a shower device, and more particularly to a combination shower-and-massage apparatus that is adjustable at various angles and positions relative to the body of one operating the device.

2. Description of the Prior Art

There have been various improvements relating to devices for taking showers and at the same time providing a massaging action which is imparted by the flow of water. One of these known devices for showering and massaging is a shower head that is mounted to a fixed outlet neck, the head being adjustable to various angles. However, this device is limited to a given location, generally above the user's head. The combination shower-and-massage shower head is well known for its ability to be adjusted to provide various angles of pulsating sprays that establish the massaging action. However, until the present invention, this type of shower head has been limited in its capabilities.

There is another well-known arrangement of a shower and massage device that comprises a hand-held unit having a nozzle head to adjust the spraying of water, the unit being connected to the water-outlet member by a flexible hose. This device has also been well received and is widely used. However, it also has its limitations as to positioning the shower head with respect to any area of the body that one might wish to cover. For example, when the device is held in the user's hand, the back area of the body can not be readily reached.

SUMMARY AND OBJECTS OF THE INVENTION

In accordance with the invention herein claimed, a new and improved combination adjustable shower-and-massage apparatus is provided having an important object to allow the user thereof to position and manipulate a massage-type shower head, whereby the flow of discharging water can readily reach any part of the user's body.

It is another object of the present invention to provide an improved combination shower-and-massage apparatus that can be readily mounted to an existing shower system, without the need for special tools or professional installation.

It is still another object of the invention to provide a shower-and-massage apparatus of this type that provides a plurality of interconnected pipe members adapted to be arranged in many cooperating positions, whereby the shower-massage head can be positioned to pulsatingly spray any part of the body—from head to feet; and also wherein the shower head can be fixedly positioned or moved in any other direction while it is being operated.

It is a further object of the invention to provide an apparatus of this character that includes a plurality of universal joint connections interposed at each pipe connection, the uppermost pipe being secured to the water outlet and the lowermost pipe being affixed to the wall of the shower area—whether it be a wall over a tub or a wall of a stall shower.

It is still a further object of the invention to provide an apparatus of this character that is easy to operate, yet simple and rugged in construction.

It is still another object of the invention to provide an apparatus of this character that is relatively inexpensive to manufacture.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operating that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
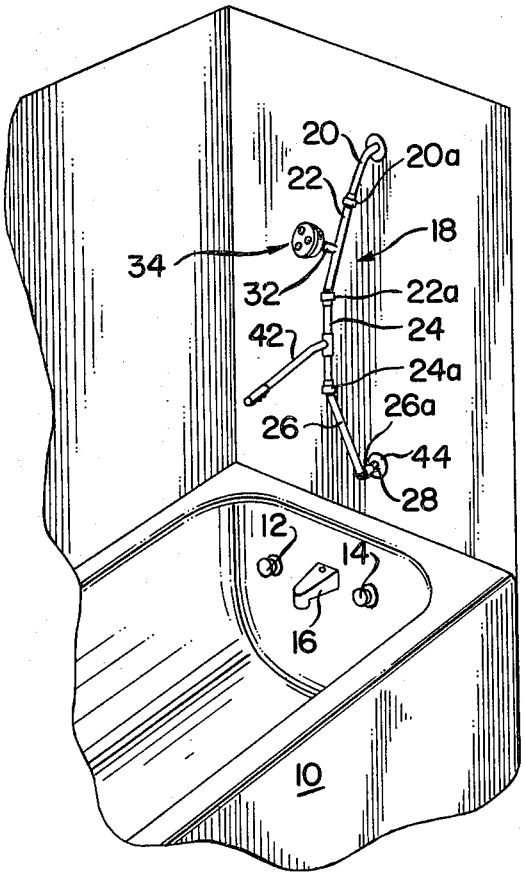
FIG. 1 is a pictorial view of the present apparatus shown mounted above a typical bathtub.
Figure 2:
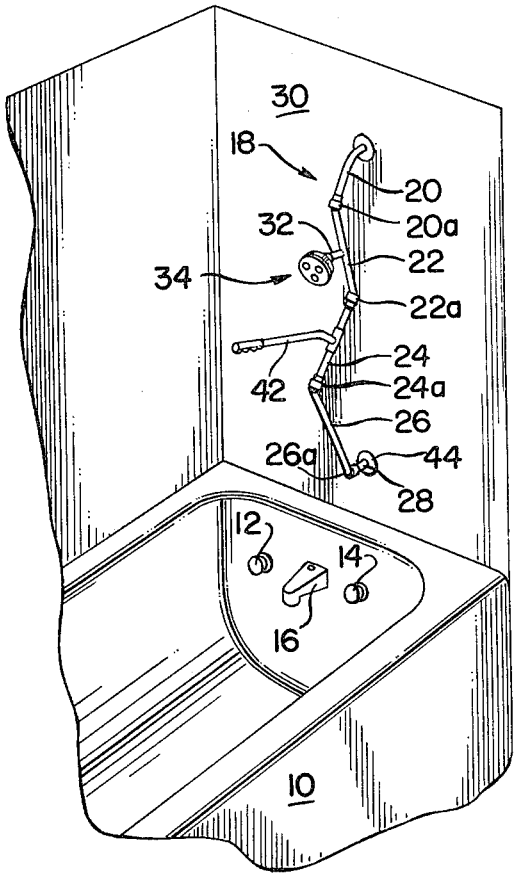
FIG. 2 is a similar pictorial view thereof, wherein the apparatus is shown in an adjusted position.
Figure 3:
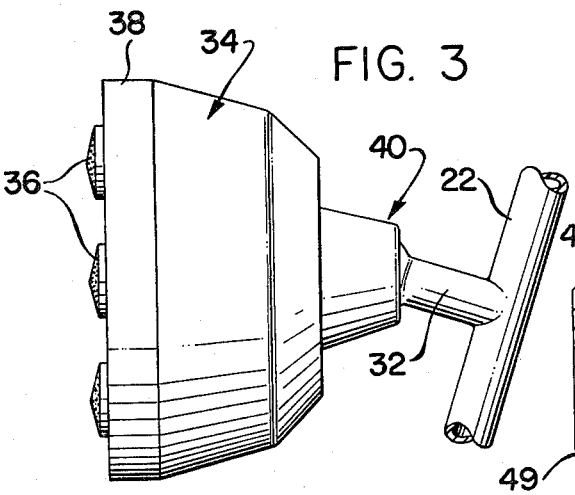
FIG. 3 is an enlarged side-elevational view of a typical shower-massage head adjustably mounted to a pipe member.

Referring more particularly to FIGS. 1 and 2, there is illustrated a bathtub, generally indicated at 10, having hot and cold water valves 12 and 14, respectively, and a typical water discharge nozzle 16 disposed therebetween. The arrangement of valves 12 and 14, with nozzle 16, is an example of one of many suitable faucet systems. As mentioned, the present apparatus is also suitable for installment in most stall-shower compartments, and the like.

Accordingly, there is illustrated a combination adjustable shower-and-massage apparatus, designated generally at 18, comprising a plurality of pipe members 20, 22, 24, 26 and 28, each pipe thereof being interconnected by a means to provide a geniculated arrangement between each pipe member, such a means being generally defined by a water-tight universal joint, indicated at 20*a*, 22*a*, 24*a* and 26*a*. Thus, pipe 20 defines a fixed neck member mounted to the typical plumbing inside wall 30. The neck 20 extends generally outward and angularly downward therefrom, normally at a location above the head of the user. Interconnected to neck 20 is a second pipe 22 which is provided with a tee member 32 which projects outwardly at right angles thereto. Tee member 32 is formed to be connected to a suitable shower head 34 of the type wherein the spray therefrom is adjustable to provide various pulsating water jets—thereby creating a massaging action.

There are several massage-type shower heads presently on the market, and any one of these known devices can be employed in combination herewith. Such shower-and-massage heads generally include a plurality of spray nozzles 36 mounted to a rotatable cover 38 by which the adjustment thereof provides several pulsating spray jets. A universal connection 40 is formed between tee member 32 and shower head 34; and thus head 34 can also be adjusted to various angular positions relative to pipe 22.

Pipe 24 is connected to pipe 22 through universal joint 22*a*, the pipe 24 being formed with an extended handle 42. Handle 42 is shown as being positioned just below shower head 34. However, it should be understood that handle 42 and pipe 24 can be placed at any given position suitable to the user; but it is shown in the preferred position. Pipe 26 is connected between pipe 24 and pipe 28, the universal joint 24*a* being connected to pipes 24 and 26; while joint 26*a* is connected to pipes 26 and 28. Hence, it is to be noted that pipe 28 is secured to the lower portion of wall 30 by bracket 44.

Figure 4:
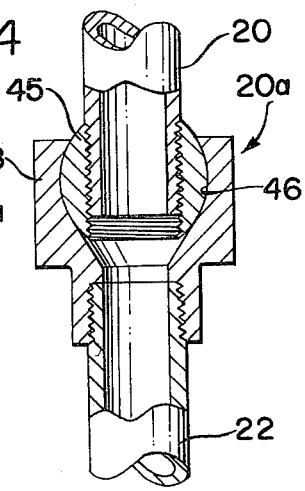
FIG. 4 is a cross-sectional view of one type of universal connecting member.

Referring now to FIG. 4, there is shown one form of a universal joint. As an example, joint 20*a* comprises a ball-joint member 45 secured to pipe 20, and adapted to move within a corresponding cavity 46 formed in joint-body member 48, to which pipe 22 is threaded. Thus, a geniculating action can be provided between the respective pipe members.

Figure 5:
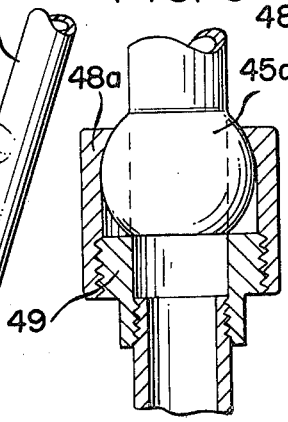
FIG. 5 is another arrangement of a universal connecting member.

FIG. 5 illustrates a second type or embodiment of a universal joint having a ball-joint member 45*a* and a body 48*a* mounted to a plug member 49. Other suitable geniculating universal means may be employed to allow free flow of water through the contiguously arranged pipes so as to communicate with shower head 34.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. In combination, an adjustable shower and massage apparatus adapted to be attached to a suitable water system having a discharge end, the apparatus comprising:

a plurality of pipe members adapted to be flexibly interconnected, and wherein there is a leading pipe member connected to the discharge end of said water system and a trailing pipe member affixed to a stationary structure such as a wall;

geniculating means provided for interconnecting said pipe members to allow each respective pipe member to be individually positioned with respect to its adjoining pipe member;

a water-spray means mounted to at least one of said pipe members; and means secured to at least one of said pipe members to position and arrange said pipe members and said water-spray means, in order to provide a selective angular discharge of water through said water-spray means.

2. An adjustable shower and massage apparatus as recited in claim 1, wherein said water-spray means comprises a shower head having means therein to provide pulsating water jets therefrom.

3. An adjustable shower and massage apparatus as recited in claim 2, wherein one of said pipe members includes a projecting tee member to allow mounting of said shower head thereon.

4. An adjustable shower and massage apparatus as recited in claim 3, wherein said geniculating means comprises a universal joint having a ball-and-socket arrangement to allow water to flow between the contiguously disposed pipe members when said pipe members are angularly positioned from each other.

5. An adjustable shower and massage apparatus as recited in claim 4, wherein said shower head includes a universal connecting means, whereby said shower head can be individually adjusted to a selected position.

6. An adjustable shower and massage apparatus as recited in claim 2, wherein said positioning means comprises a handle member secured to at least one of said pipe members.

* * * * *